United States Patent [19]

Kishida et al.

[11] Patent Number: 5,048,497

[45] Date of Patent: Sep. 17, 1991

[54] FUEL INJECTION UNIT

[75] Inventors: Hajime Kishida; Takeo Yoshida, both of Iwata, Japan

[73] Assignee: Yamaha Hatsudoki Kabushiki Kaisha, Iwata, Japan

[21] Appl. No.: 483,119

[22] Filed: Feb. 22, 1990

[30] Foreign Application Priority Data

Feb. 22, 1989 [JP] Japan ..... 1-42561

[51] Int. Cl.[5] ..... F02M 67/02; F02M 55/00

[52] U.S. Cl. ..... 123/533; 239/408; 239/416.5; 239/417.5; 239/585

[58] Field of Search ..... 123/531-535; 239/408, 416.5, 417.5, 585

[56] References Cited

U.S. PATENT DOCUMENTS

| | | | |
|---|---|---|---|
| 1,627,727 | 5/1927 | Charter | 123/531 |
| 4,556,037 | 12/1985 | Wisdom | 123/533 X |
| 4,703,740 | 11/1987 | Trapy | 123/531 |
| 4,771,754 | 9/1988 | Reinke | 123/533 |
| 4,794,901 | 1/1989 | Hong et al. | 123/533 |
| 4,794,902 | 1/1989 | McKay | 123/533 |
| 4,934,329 | 6/1990 | Lear et al. | 123/456 X |
| 4,986,247 | 1/1991 | Kushibe et al. | 123/533 |

FOREIGN PATENT DOCUMENTS

| | | | |
|---|---|---|---|
| 906418 | 1/1946 | France | 123/531 |
| 305527 | 2/1955 | Switzerland | 123/533 |

*Primary Examiner*—Tony M. Argenbright
*Attorney, Agent, or Firm*—E. A. Beutler

[57] ABSTRACT

A number of embodiments of fuel injection systems using air/fuel injection and wherein the fuel is not delivered to the injection unit until after the injection valve is open so that fuel cannot flow back into the pressurized air system. In some embodiments, a single valve element and valve seat controls the flow of both fuel and air.

14 Claims, 6 Drawing Sheets

FUEL INJECTION UNIT

BACKGROUND OF THE INVENTION

This invention relates to a fuel injection unit and more particularly to an improved fuel injection unit that discharges both fuel and pressurized air for an engine combustion.

It is well known that the use of fuel injection can be very efficient in controlling the operation of an internal combustion engine. Fuel injection systems can provide good fuel economy and the control of unwanted exhaust gas constituents. Fuel injection systems can be particularly useful in conjunction with two cycle internal combustion engines since such engines, for their normal running, require a fairly substantial degree of overlap between the opening of the intake and scavenge ports and the closing of the exhaust port. It is obviously important to insure that the combusted mixture from the previous cycle be fully exhausted, but also it is important to insure that none of the fresh fuel/air mixture entering the engine will be discharged through the exhaust port. Fuel injection systems can be useful in insuring this result.

One well known type of fuel injection system and one which has, in fact, been used since the advent of the internal combustion engine, provides injection of both fuel and air from the injection unit. These devices work in a wide variety of manners and most generally the fuel is introduced to a chamber wherein the pressurized air resides. When the injection valve then opens, the fuel and pressurized air will both be delivered to the engine for combustion. However, this type of system has a particular disadvantage.

Specifically, it is obviously necessary to deliver the pressurized fuel to the mixing chamber at a pressure that is higher than the air pressure. When this is done, the fuel will not only enter the mixing chamber, but can flow back through the air admission system and hence when the injection valve is open, not all of the fuel may be discharged. Alternatively, the fuel discharge can be erratic from cycle to cycle as the fuel in the air system will not be discharged at regular intervals.

It is, therefore, a principal object of this invention to provide an improved fuel injection unit for an internal combustion engine.

It is a further object of this invention to provide an improved fuel injection unit for an internal combustion engine that injects both air and fuel to the engine but which will insure that the amount of fuel discharged from cycle to cycle will be uniform and the engine will run evenly under all conditions.

It is yet a further object of this invention to provide a fuel/air injection unit for an internal combustion engine wherein the fuel cannot flow into the air delivery system for the injection unit.

In order to provide the aforedescribed results, it is possible to control both the fuel and air admission by separate valves and to insure that the fuel controlling valve does not open until after the main injection has begun. Of course, this complicates the number of valves and porting arrangements that must be employed.

It is, therefore, a still further object of this invention to provide an improved fuel injection unit having a single valve arrangement that will control both the admission of the fuel and the air to the engine.

SUMMARY OF THE INVENTION

A first feature of this invention is adapted to be embodied in a fuel injection unit for injecting fuel and pressurized air to an engine for its combustion. The injection unit comprises an injection valve means for controlling the flow of fuel and air to the engine. A source of pressurized air communicates with the injection valve means for discharge of pressurized air to the engine when the injection valve means is opened. An intermittently operated source of pressurized fuel is provided for sequentially discharging fuel into the fuel injection unit for discharge of the fuel to the engine upon opening of the injection valve means. In accordance with this feature of the invention, pressurized fuel is not delivered to the injection unit valve means until after the injection unit valve means is opened.

Another feature of the invention; is adapted to be embodied in a fuel injection unit for injecting fuel and pressurized air to an engine for combustion. Such a fuel injection unit comprises a single injection valve moveable between an opened position and a closed position. A source of pressurized air supplies pressurized air to the upstream side of the injection valve. A source of pressurized fuel communicates with the injection valve at its seat so that fuel cannot be discharged until the valve is in its open position so that the valve controls both the flow of fuel and air.

DETAILED DESCRIPTION OF THE PREFERRED EMBODIMENTS OF THE INVENTION

Figure 1:
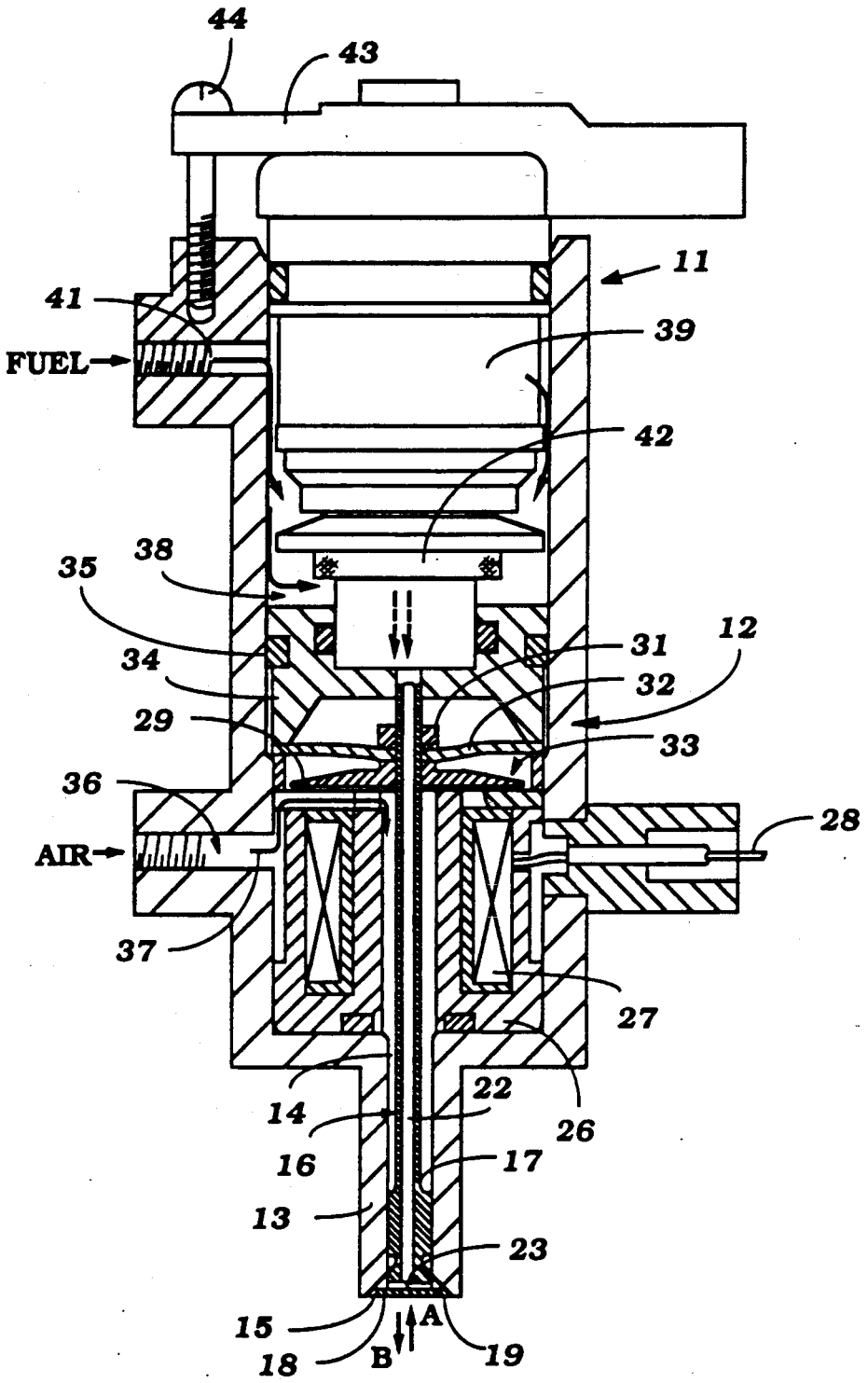
FIG. 1 is a longitudinal cross sectional view taken through a fuel injection unit constructed in accordance with a first embodiment of the invention.
Figure 2:
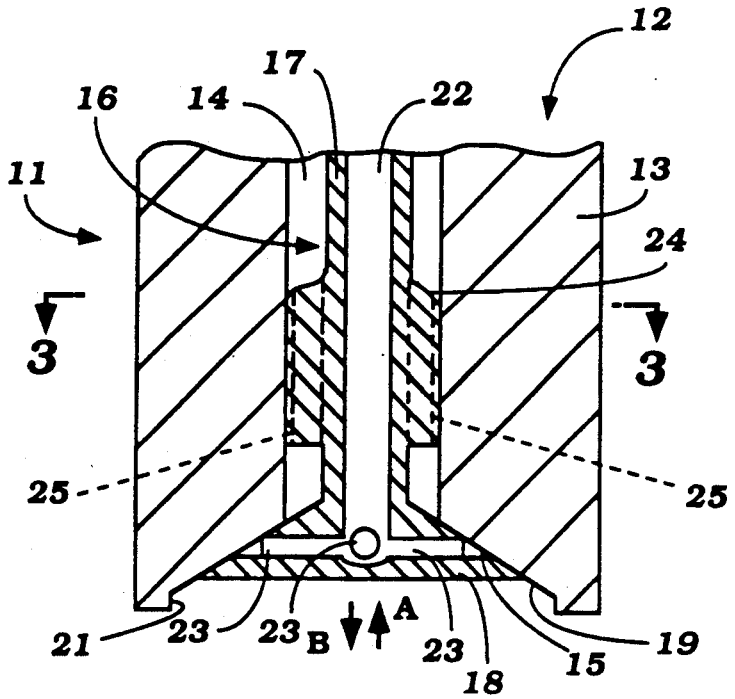
FIG. 2 is an enlarged cross sectional view, on the same plane as FIG. 1, showing the injection valve element and its cooperation with the valve seat.
Figure 3:
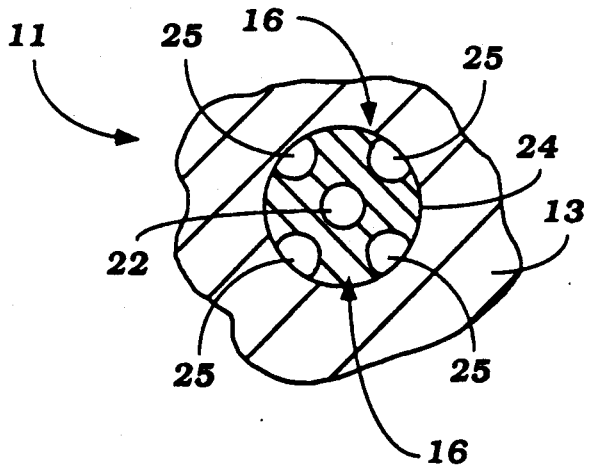
FIG. 3 is a cross sectional view taken along the line 3—3 of FIG. 2.

Referring first to the embodiment of FIGS. 1 through 5 and initially to FIGS. 1 through 3, a fuel injection unit constructed in accordance with an embodiment of the invention is identified generally by the reference numeral 11. The fuel injection unit 11 includes an outer housing assembly 12 that includes a nozzle tip portion 13 that is adapted to be detachably affixed, as by a threaded connection, so as to extend into a portion of an internal combustion engine (not shown). Normally, the portion 13 will communicate directly with the combustion chamber of the engine and the injection unit 11 has particular utility in conjunction with two cycle crankcase compression internal combustion engines As such, the nozzle portion 13 will communicate with the combustion chamber of the engine either through the cylinder head or through the cylinder itself at a position above top dead center of the piston.

The nozzle tip 13 is provided with a through bore 14 which terminates at its lower end in a valve seat 15 as shown in most detail in FIG. 2 A valve element, indicated generally by the reference numeral 16 has a hollow stem portion 17 that extends through the bore 14. A head portion 18 of the valve 16 is adapted to engage in its closed position the seat 15 so as to preclude flow from the bore 14 into the combustion chamber. It will be noted that the head portion 18 has a peripheral edge 19 that is spaced inwardly from the outer extremity of the seat 15 and is contained within a partially shrouded area 21 for controlling the direction of spray from the injection unit 11.

A fuel supply port 22 extends coaxially through the stem 17 and terminates a plurality of radially extending bores 23 that extend through the head portion 18 and which terminate in the seating surface of the head 18 which is normally engaged with the valve seat 15. As a result, the passages 23 will be closed when the valve 16 is in its closed position. Fuel is supplied, in a manner to be described, to the passage 22.

It will be noted that the valve element 16 has an enlarged portion 24 that is slidably supported within the bore 14 so as to guide the lower end of the valve 16 adjacent its head 18. However, a plurality of relief passages 25 extend axially along the peripheral sides of the enlarged portion 24 so as to permit air to flow from a source, to be described, for discharge through the valve seat 15 when the valve 16 is in its opened position.

Above the nozzle portion 13, the housing 12 is formed with a first bore in which the core 26 of a solenoid winding 27 is contained. The solenoid winding 27 is provided with terminals 28 that are connected to a suitable power source for selective energization of the winding 27 to open the valve 16 in a manner which will be described.

Above the winding 27, an armature plate 29 is affixed to the stem portion 17 of the valve 16 by means including a locking nut 31. The nut 31 also holds a diaphragm spring 32 to the valve 16. The diaphragm spring 32 is designed so as to provide a biasing force on the valve 16 in the direction of the arrow A so as to hold the valve head 18 in its closed position. When the winding 27 is energized, the armature plate 29 will be drawn downwardly and the valve 16 will be moved in the direction of the arrow B to its opened position.

A pressurized air chamber 33 is formed beneath a cylindrical sleeve 34 that is held in a bore of the housing 12 and which is sealed thereto by an O ring seal 35. Pressurized air is delivered to this chamber 33 through an air inlet port 36. The air inlet port 36 may be continuously pressurized or air under pressure may be supplied sequentially to the port 36. This air can flow through the direction indicated by the arrow 37 so as to enter the bore 14 and be discharged from the injection unit 11 when the valve 16 is in its opened position. Although the timing of the air flow can be altered, normally pressure exists before the valve element 16 is opened until after the valve element 16 is closed. As has been noted, however, preferably the chamber 33 is continuously pressurized.

A fuel supply chamber, indicated generally by the reference numeral 38, is formed in the housing 12 above the sleeve 34. Contained within this fuel supply chamber 38 is an electrically operated fuel injector 39 that receives fuel through a supply port 41 and which discharges pressurized fuel through a fuel filter 42 to the chamber 38 and for discharge down through the central passageway 22 of the valve stem 17. As has been previously noted, when the valve 16 is in its opened position, the ports 23 will be uncovered and fuel can be discharged in a generally radial direction relative to the air flow from the bore 14. As a result, the air flow will cause good atomization of the fuel as discharged from the injection unit 11.

Figure 4:
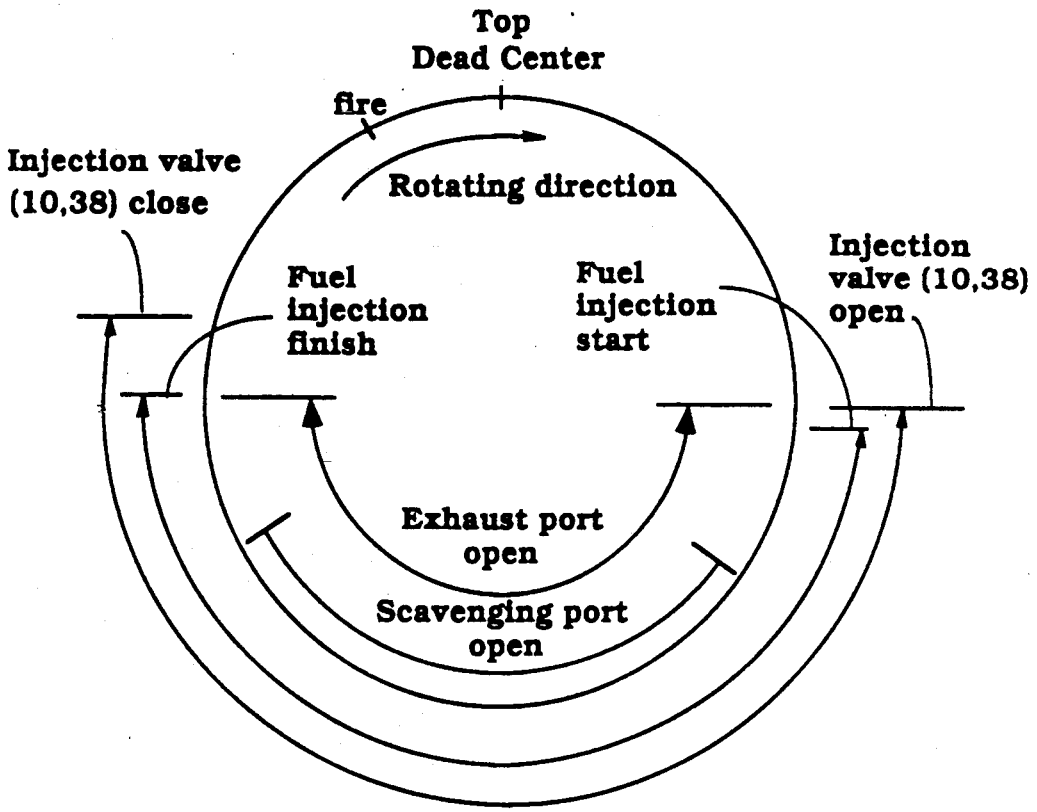
FIG. 4 is a timing chart showing the crankcase rotation and valve port timing and injection valve timing.
Figure 5:
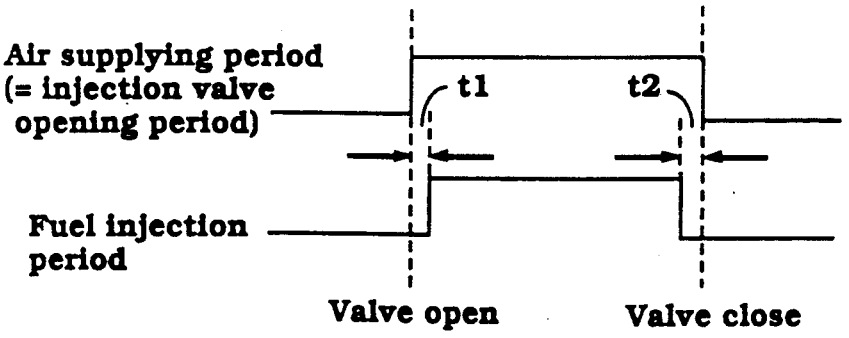
FIG. 5 is a time diagram showing the operating sequence for the injection valve and the period of fuel injection.

The fuel injection sequence can be best understood by reference to FIGS. 4 and 5 with FIG. 4 being a timing curve for crankshaft angle rotation as shown in a clockwise direction while FIG. 5 is a timing diagram showing the pulses during which the fuel injection from tho fuel injector 39 and air injection controlled by the opening of the valve 16 are depicted. The described timing arrangement of FIG. 4 is that of a two cycle crankcase compression engine. Hence there is one firing per revolution of the crankshaft. However, the principles of the invention can be utilized in conjunction with four cycle engines. The invention has particular utility, however, in conjunction with two cycle engines.

As may be readily seen, at a certain crank angle, the exhaust charge from the previous cycle can be discharged. At some time after this, the injection valve 16 is opened when there is air under pressure in the inlet port 36 and air will issue from the open valve seat 15 when the valve head 18 moves away from it. After some brief delay fuel injection will begin by operation of the injector 39.

As has been previously noted, the fuel will spray radially outwardly through the ports 23, be atomized by the air flow and delivered to the engine. Eventually, the scavenge port will open and injection is continued up until about the time when the exhaust port closes. At this time, the fuel injector 39 will complete its fuel injection, but air will continue to be injected because the valve head 18 will still be away from the valve seat 15. The valve 16 then closes and the charge will eventually be fired.

FIG. 5 also shows the timing of the air injection period and fuel injection. It will be seen that fuel injection is delayed for a time t1 until after the valve 18 has been opened and is discontinued at a time t2 before the valve closes. Of course, other timing arrangements may be employed. It is important, however, to insure that fuel injection is not begun until after the valve 16 is open so that no fuel can find its way back into the air injection system which would cause the uneven running as aforenoted.

Even though it is desirable to insure that fuel injection is not begun until after the valve 16 is opened, this may involve actually energizing the fuel injector 39 before the valve 16 actually opens. This is because there is a greater inertia in the fuel injection system than the operation of the valve 16 and, accordingly, to ensure simultaneous start of both fuel and air injection, the injector 39 may be pulsed before the valve 16 is actuated. However, as has been noted, it is desirable to insure that fuel pressure will not exist in the system before the valve is opened.

Of course, the time and duration of opening of the valve 16 and the amount of fuel injected by the injector 39 will be varied to suit variations in engine running characteristics. Basically, the duration of injection will be short at low speed and low loads and longer at high speeds and high loads. This can be controlled in any suitable manner.

Figure 6:
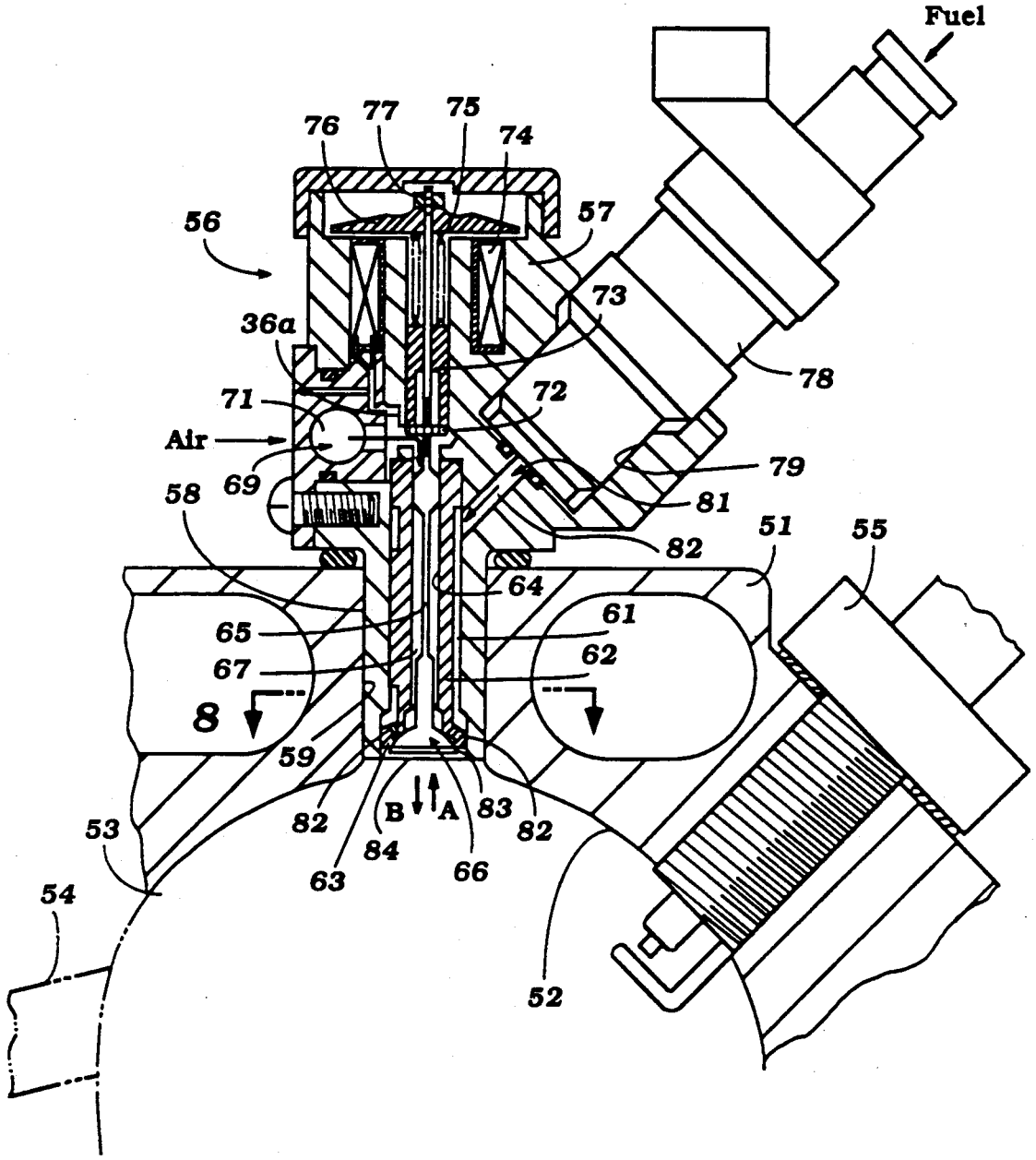
FIG. 6 is a cross sectional view taken through a cylinder of an internal combustion engine having a fuel injection unit constructed in accordance with another embodiment of the invention.
Figure 7:
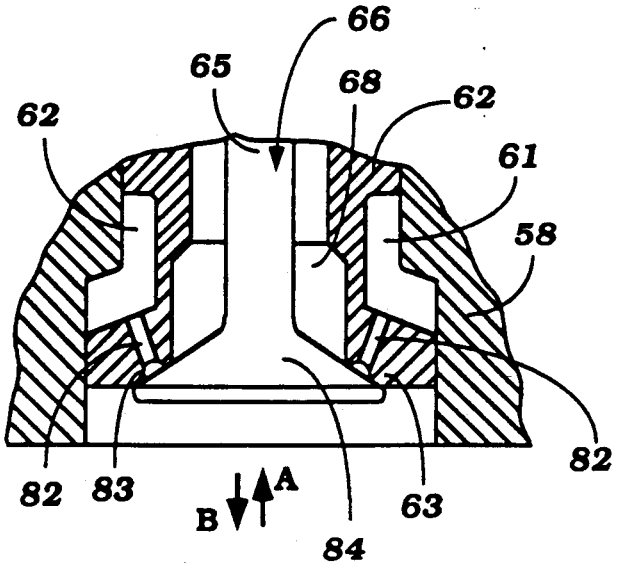
FIG. 7 is an enlarged cross sectional view showing the valve element of this embodiment.
Figure 8:
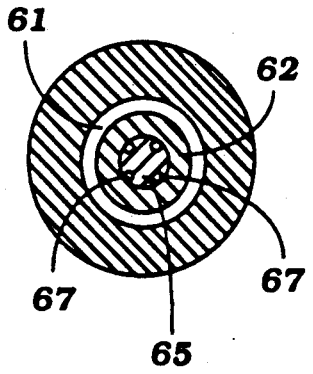
FIG. 8 is a cross sectional view taken along the line 8—8 of FIG. 6.

FIGS. 6 through 8 show another embodiment of the invention wherein the fuel is delivered not through a hollow stem of the valve but rather externally, as will be described. In this embodiment, a portion of the engine is also depicted. This includes the cylinder block 51 having a cylinder bore 52 in which a piston 53 reciprocates. The scavenge ports do not appear in this figure, but the exhaust port is indicated at 54 and the spark plug at 55.

The injection unit is indicated generally by the reference numeral 56 and include a main body portion 57 that has a nozzle part 58 that is threaded into a tapped bore 59 of the cylinder block 51. A through bore is formed in the nozzle portion 58 and defines an annular cavity 61. The cavity 61 is isolated by a seat insert 62 that is formed with a valve seat portion 63 as best seen in FIG. 7.

The insert 62 is formed with a bore 64 in which a stem portion 65 of an injection control valve, indicated generally by the reference numeral 66, is slidably supported. The injection valve has enlarged portions that nevertheless define flow passages 67 so that air as will be described flow into the bore 64 and a chamber 68 formed by the valve insert 62 adjacent the seat portion 63. This air is delivered through an air manifold, indicated generally by the reference numeral 69 that terminates in a passageway 71 which communicates with the bore 64 as shown by the arrow in FIG. 6.

The valve stem 65 is connected by means of a nut 72 to an armature 73 of an electromagnet assembly that is contained within the upper portion of the housing 57. This electromagnet assembly includes a winding 74 that has terminals which are energized in a suitable manner. A coil compression spring 75 engages an armature plate 76 that is held on an extension of the valve stem 65 by means of a nut 77 for urging the injection valve 66 to its closed position. When the winding 74 is energized, the armature disk 76 will be drawn downwardly and the valve 66 will be opened as shown by the arrow B.

A fuel injector 78 is contained within a bore 79 formed at one side of the housing 57 and which communicates with a fuel delivery passageway, indicated generally by the reference numeral 81 and including a passage 82 that interconnects the bore 79 with the recess 61. At the lower end, the area 61 is formed with a plurality of ports 82 that terminate in the valve seat 63 inwardly of the outer periphery 83 of the head 84 valve 66. As a result, when the valve head 66 moves to its open position, fuel can be injected and will be atomized by the air flow passed this area. Thus, fuel atomization will be achieved as in the previously described embodiment and the single valve head and valve seat control the flow of both fuel and air. The fuel/air timing can be as in the previously described embodiment or variations thereof, as have already been described.

Figure 9:
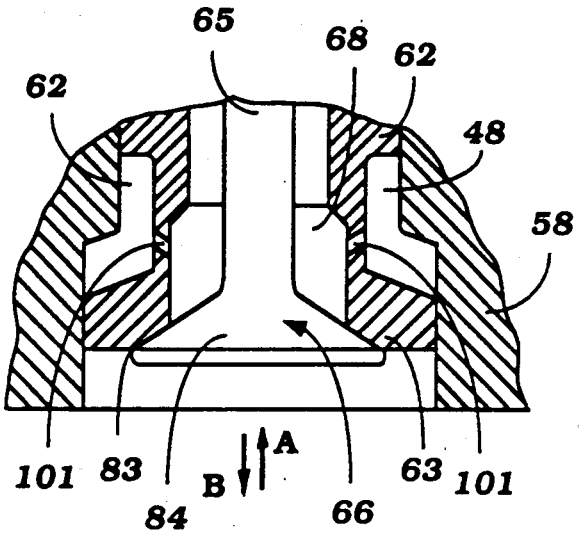
FIG. 9 is a cross sectional view, in part similar to FIGS. 2 and 7, and shows yet another embodiment of the invention.

FIG. 9 shows another embodiment of the invention, which is generally the same as the embodiment of FIGS. 6 through 8. In this embodiment, however, rather than having the passages from the chamber 61 and 62 enter into the valve seat portion, fuel is delivered from this area by ports 101 directly into the counter bore 68. Again, the air flow will pass by the outlets of the fuel injection openings and, accordingly, there will be good atomization. With this embodiment, the fuel injector 78 is not operated until after the valve 66 is opened.

It should be readily apparent from the foreqoing description that a number of embodiments of the invention have been illustrated and described, each of which will insure good fuel atomization and uniform fuel delivery for each cycle of operation. This is because there will be no fuel entering back into the air injection system since fuel injection is not begun before the injection valve is open. Also, in some embodiments, one valve member and valve seat control both air and fuel flow. Of course, various changes and modifications may be made without departing from the spirit and scope of the invention, as defined by the appended claims.

We claim:

1. A fuel injection unit for injecting fuel and pressurized air to an engine for combustion comprising injection valve means moveable between an opened position and a closed position for controlling the flow of fuel and air to the engine, a source of pressurized air communicating with said injection valve means for discharge to the engine when said injection valve means is open, an intermittently operated fuel injector source of pressurized fuel for sequentially discharging fuel into said fuel injection unit and for discharge of fuel to the engine upon opening of said injection valve means, and control means for controlling the operation of said injection valve means and of said fuel injector so that fuel is not injected by said fuel injector until said control means has operated said injection valve means to its open position.

2. A fuel injection unit as set forth in claim 1 wherein the control means operates the fuel injector so that fuel is not injected by said fuel injector until said injection valve means is operated to its open position under all running conditions of the engine.

3. A fuel injection unit as set forth in claim 1 wherein the control means for the fuel injector is operative to prevent any discharge of fuel during the time when the injection valve means is closed by said control means.

4. A fuel injection unit as set forth in claim 3 wherein the control means prevents the discharge of fuel during the time when the injection valve means is closed under all running conditions of the engine.

5. A fuel injection for injecting fuel and pressurized air to an engine for combustion comprising injection valve means for controlling the flow of fuel and air to the engine, a source of pressurized air communicating with said injection valve means for discharge to the engine when said injection valve means opens, an intermittently operated fuel injector source of pressurized fuel for sequentially discharging fuel into said fuel injection unit and for discharge of fuel to the engine upon opening of said injection valve means, and control means for controlling the operation of said fuel injector so that fuel is not injected until the injection valve means is open, said control means for said fuel injector being operative to begin fuel injection after said injection valve means opens and to stop the fuel injection before said injection valve means closes.

6. A fuel injection unit as set forth in claim 5 wherein the control means is operative to begin fuel injection after the injection valve means opens and to stop the fuel injection before said injection valve means closes under all running conditions of the engine.

7. A fuel injection unit for injecting fuel and pressurized air to an engine for combustion comprising injection valve means for controlling the flow of fuel and air to the engine, a source of pressurized air communicating with said injection valve means for discharge to the engine when said injection valve means opens, an intermittently operated fuel injector source of pressurized fuel for sequentially discharging fuel into said fuel injection unit and for discharge of fuel to the engine upon opening of said injection valve means, and control means for controlling the operation of said fuel injector so that fuel is not injected until the injection valve means is open, said injection valve means comprising a common valve element and valve seat for controlling both fuel and air flow.

8. A fuel injection unit as set forth in claim 7 wherein the fuel injector injects fuel into an area that communicates with the valve seating area so that fuel cannot be discharged until the valve is open.

9. A fuel injection unit set forth in claim 8 wherein the control means does not commence fuel injection until after the injection valve means is open.

10. A fuel injection unit as set forth in claim 8 wherein the control means for the fuel injector is operative to prevent any discharge of fuel during the time when the injection valve means is closed.

11. A fuel injection unit as set forth in claim 10 wherein the control means or the fuel injector is operative to begin the fuel injection after the injection valve means opens and to stop the fuel injection before the injection valve means closes.

12. A fuel injection unit for injecting fuel and pressurized air to an engine for combustion comprising a single injection valve element and cooperating valve seat, means for supplying a source of pressurized air to a chamber upstream of said valve seat and communicating with said valve seat for discharge of air when said valve element moves away from said valve seat, a fuel passage communicating at a discharge end directly to the seating area of said valve, and a fuel injector for injecting a spray of fuel into said fuel passage at a point spaced upstream of said discharge end for discharge of fuel from said fuel injection unit when the valve element is spaced from said valve seat.

13. A fuel injection unit as set forth in claim 12 wherein the fuel passage extends through the valve element.

14. A fuel injection unit as set forth in claim 12 wherein the fuel passage discharge end is formed in the valve seat.

* * * * *

UNITED STATES PATENT AND TRADEMARK OFFICE

CERTIFICATE OF CORRECTION

PATENT NO. : 5,048,497

DATED : September 17, 1991

INVENTOR(S) : Kishida, et al

It is certified that error appears in the above-identified patent and that said Letters Patent is hereby corrected as shown below:

Col. 7, line 17, Claim 9, after "unit" insert --as--

Column 8, line 2, Claim 11, "or" should be --for--.

Signed and Sealed this

Thirteenth Day of July, 1993

*Attest:*

Michael K. Kirk

MICHAEL K. KIRK

*Attesting Officer*

*Acting Commissioner of Patents and Trademarks*